US005595492A

United States Patent [19]

Taguchi

[11] Patent Number: 5,595,492

[45] Date of Patent: Jan. 21, 1997

[54] CONNECTOR HOUSING COUPLING MECHANISM

[75] Inventor: Naoto Taguchi, Shizuoka, Japan

[73] Assignee: Yazaki Corporation, Tokyo, Japan

[21] Appl. No.: 359,995

[22] Filed: Dec. 20, 1994

[30] Foreign Application Priority Data

Dec. 20, 1993 [JP] Japan ..... 5-344592

[51] Int. Cl.[6] ..... H01R 13/62

[52] U.S. Cl. ..... 439/157

[58] Field of Search ..... 439/152–157

[56] References Cited

U.S. PATENT DOCUMENTS

| | | | |
|---|---|---|---|
| 5,178,553 | 1/1993 | Hatagishi et al. | 439/157 |
| 5,269,696 | 12/1993 | Okada et al. | 439/157 |
| 5,308,255 | 5/1994 | Yamanashi | 439/157 |
| 5,320,544 | 6/1994 | Naoto et al. | 439/157 |
| 5,328,377 | 7/1994 | Saito | 439/157 |
| 5,453,018 | 9/1995 | Ito et al. | 439/153 |

FOREIGN PATENT DOCUMENTS

| | | | |
|---|---|---|---|
| 52-133993 | 10/1977 | Japan | H01R 13/62 |
| 0056877 | 2/1990 | Japan | 439/157 |

*Primary Examiner*—Neil Abrams
*Assistant Examiner*—Brian J. Biggi
*Attorney, Agent, or Firm*—Sughrue, Mion, Zinn, Macpeak & Seas

[57] ABSTRACT

A connector housing coupling mechanism includes an engaging projection which is formed on a side face of one of female and male connector housings, and an operating lever which is rotatably supported on a side face of the other one of the female and male connector housings, the operating lever including a cam groove which receives and guides the engaging projection depending on a rotation position of the operating lever, an innermost portion of the cam groove being closer to a rotation center of the operating lever than an entrance of the cam groove, the female and male connector housings being coupled with and uncoupled from each other by rotating the operating lever. In the mechanism, a lever locking unit for inhibiting the operating lever from being rotated includes an engaging unit which, when connectors are uncoupled from each other, is located at a position where the engaging unit does not engage with the operating lever; and an urging unit for, when the connectors are coupled with each other, urging the engaging unit to a position where the engaging unit engages with the operating lever, the operating lever being prevented by the engaging unit from being rotated, only when the connectors are coupled with each other.

2 Claims, 5 Drawing Sheets

CONNECTOR HOUSING COUPLING MECHANISM

BACKGROUND OF THE INVENTION

The present invention relates to an improvement of a connector housing coupling mechanism for coupling a pair of male and female connector housings with each other which are used for connection of electric wires.

Recently, in accordance with an increase in the number of signal lines due to increased electronic parts, many kinds of male and female connector housings which are used for connection of electric wires are designed so as to accommodate a large number of terminal pieces or to be adopted for a multiterminal connector. In a pair of such male and female connector housings, there are tendencies to set the contact pressure exerted between terminal pieces to be higher than a specified value irrespective of the number of terminals in view of influence of vibration or the like. When such male and female connector housings are to be mated or unmated, a mating or unmating force larger than the friction engaging force appearing between the terminal pieces must be exerted. In the case where terminal pieces to be connected are increased in number, consequently, it is required to exert a very large force in order to couple male and female connector housings with each other or separate them from each other.

To comply with this, conventionally, various connector housing coupling mechanisms which are designed so as to facilitate the coupling and separation of male and female connector housings have been proposed. For example, Japanese Utility Model Unexamined Publication (Kokai) No. SHO 52-133993 discloses a connector housing coupling mechanism in which an engaging projection is formed on a side face of one of male and female connector housings, and an operating lever is rotatably supported on a side face of the other one of the connector housings. When the operating lever is rotated under the state where the engaging projection is received in a cam groove formed in the operating lever, the male and female connector housings are coupled with or separated from each other.

In the connector housing coupling mechanism, as shown in FIGS. 8(*a*) and 8(*b*), an engaging projection 3 is formed on a side face of a female connector housing 1 which is the side face of one of the male and female connector housings, and an operating lever 4 is disposed on a side face of a male connector housing 2 which is the side face of the other connector housing, in such a manner that the operating lever 4 is rotatable in a plane which is substantially parallel to the directions of mating and unmating the connector housings. The operating lever 4 is provided with a guide groove 5 which receives and guides the engaging projection 3 depending on the rotating position of the operating lever. The guide groove 5 is so configured that the innermost portion is closer to the rotation center of the operating lever 4 than the entrance of the groove. In this configuration, when the operating lever 4 is rotated while the engaging projection 3 is received in the guide groove 5, the male and female connector housings 2 and 1 can be coupled with or separated from each other with a small operating force.

The male connector housing 2 on which the operating lever 4 is rotatably supported is provided with a locking spring 6 functioning as lever locking means. The locking spring 6 engages with the operating lever 4 which is rotated so as to accomplish a state where the male and female connector housings 2 and 1 are completely coupled with each other. As shown in FIG. 8(*b*), the operating lever 4 is locked so as not to be accidentally rotated in the direction along which the male and female connector housings 2 and 1 are separated from each other.

In such a connector housing coupling mechanism of the operating lever type, even when the male connector housing 2 which is provided with the operating lever 4 stands alone as shown in FIG. 9, the operating lever 4 may be rotated to engage with the locking spring 6 to enter the lock-up state where the operating lever 4 is locked so as not to be rotated.

When the male connector housing 2 in which the operating lever 4 has once been engaged with the locking spring 6 is to be coupled with the female connector housing 1, the operating lever 4 must be disengaged from the locking spring 6 before conducting the coupling operation so that the lock-up state is canceled, thereby producing a problem in that the workability of the connector coupling operation is impaired.

SUMMARY OF THE INVENTION

The present invention has been constructed in order to solve the problem. It is an object of the invention to provided a connector housing coupling mechanism of the operating lever type in which, under the state where male and female connector housings are not coupled with each other, an operating lever disposed on one of the connector housings is not inhibited by lever locking means from being rotated so that an excellent workability is attained in the coupling operation.

The object of the invention is attained by a connector housing coupling mechanism comprising an engaging projection which is formed on a side face of one of male and female connector housings, and an operating lever which is rotatably supported on a side face of the other one of the male and female connector housings, the operating lever comprising a cam groove which receives and guides the engaging projection depending on a rotation position of the operating lever, an innermost portion of the cam groove being closer to a rotation center of the operating lever than an entrance of the cam groove, the male and female connector housings being coupled with and uncoupled from each other by rotating the operating lever, wherein lever locking means for inhibiting the operating lever from being rotated comprises: engaging means which, when connectors are uncoupled from each other, is located at a position where the engaging means does not engage with the operating lever; and urging means for, when the connectors are coupled with each other, urging the engaging means to a position where the engaging means engages with the operating lever, the operating lever being prevented by the engaging means from being rotated, only when the connectors are coupled with each other.

Preferably, the engaging means is a flexible locking piece which is formed on a side face of one of the male and female connector housings, the flexible locking piece elongating in a connector insertion direction, and the urging means is a pushup means formed on a side face of the other one of the male and female connector housings, the side face opposing the flexible locking piece, and, when the connectors are coupled with each other, the pushup means pushes up the flexible locking piece to bend the flexible locking piece to a position where the flexible locking piece is engaged with the operating lever, thereby inhibiting the operating lever from being rotated.

In the configuration of the invention, when the male and female connector housings are separated from each other, the engaging means of the lever locking means which engages with the operating lever to inhibit the operating lever from being rotated is at the position where the engaging means does not engage with the operating lever, and hence the lever locking means does not inhibit the operating lever from being rotated.

In other words, when one of the connector housings which is provided with the operating lever stands alone, an occasion in which the operating lever is engaged with the lever locking means does not occur. In the operation of coupling the male and female connector housings with each other, therefore, it is not required to conduct the burdensome task of disengaging the operating lever from the lever locking means.

In contrast, when the male and female connector housings are to be coupled with each other, the engaging means is urged by the urging means to the position where the engaging means engages with the operating lever, to engage with the operating lever. Therefore, the operating lever is inhibited from being rotated in the direction along which the male and female connector housings are separated from each other, so that the coupling state of the male and female connector housings is not accidentally canceled.

DETAILED DESCRIPTION OF THE PREFERRED EMBODIMENTS

Hereinafter, preferred embodiments of the connector housing coupling mechanism of the present invention will be described in detail with reference to the accompanying drawings.

Figure 1:
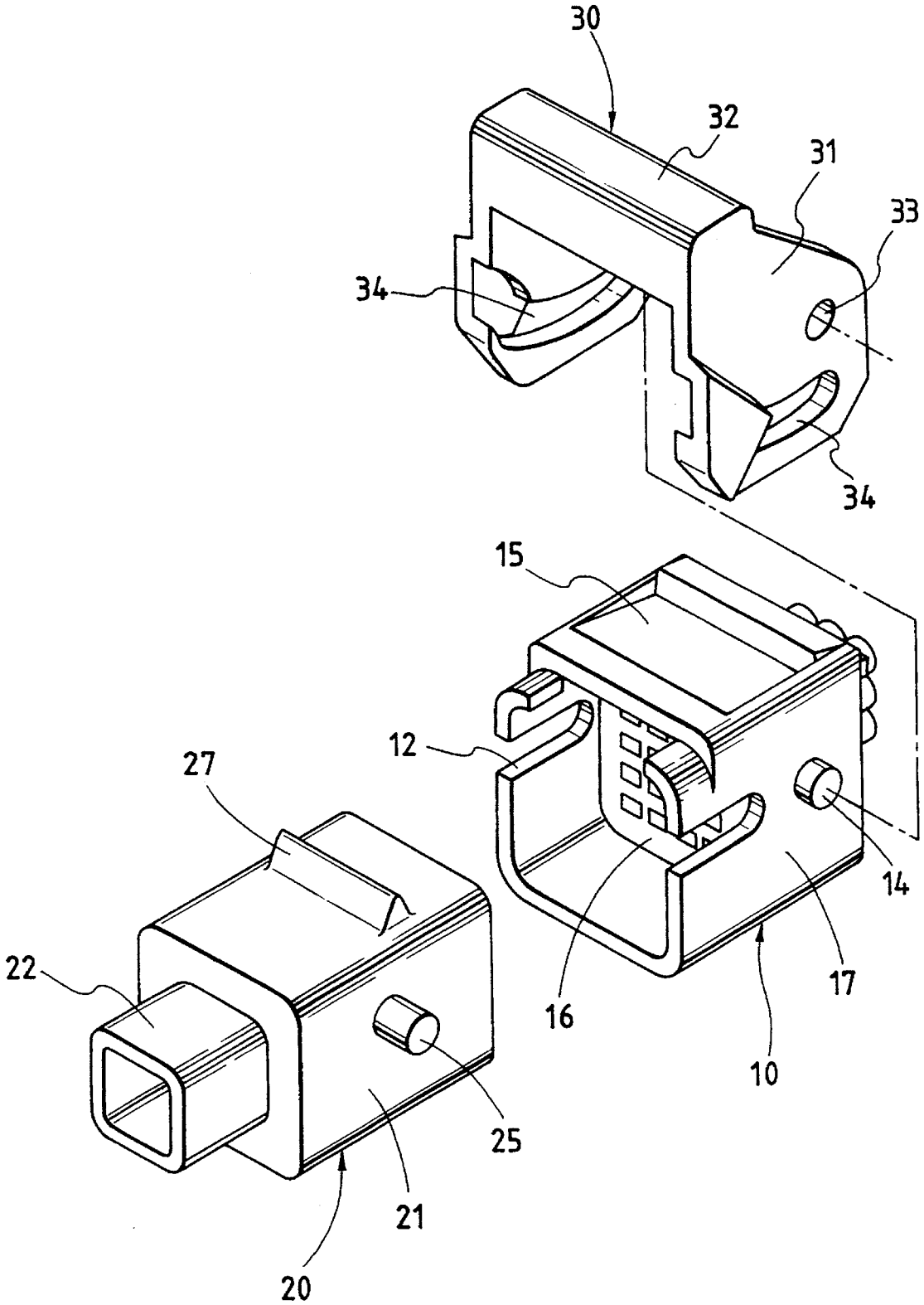
FIG. 1 is an exploded perspective view of male and female connector housings having a connector housing coupling mechanism which is an embodiment of the invention.
Figure 2:
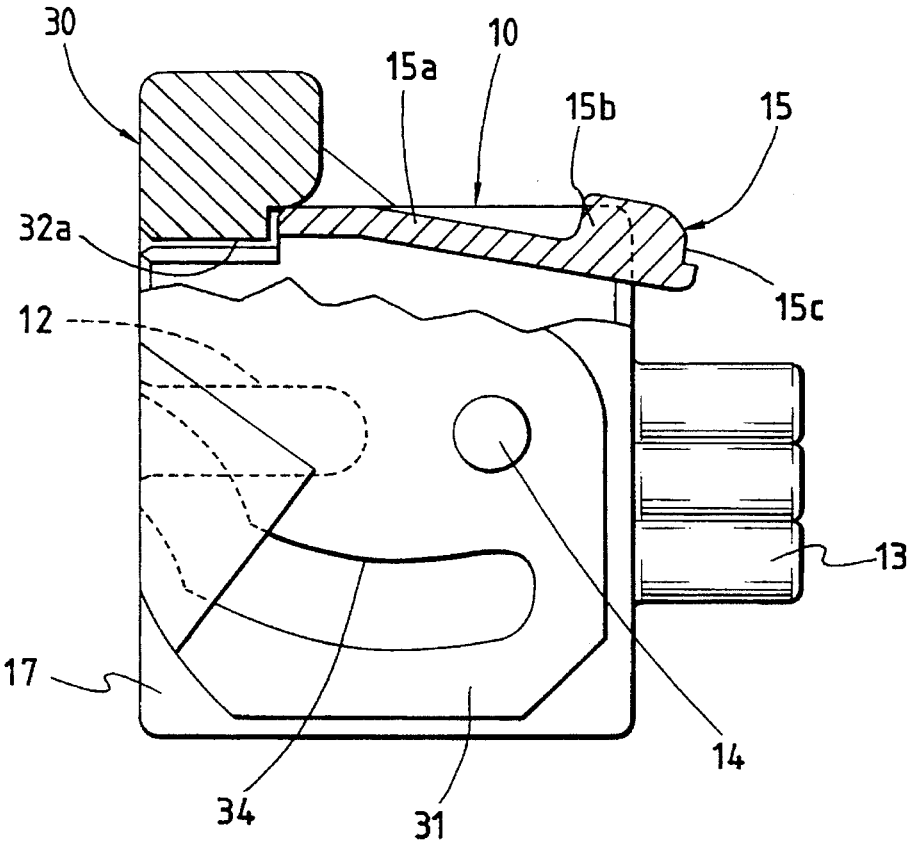
FIG. 2 is a partially cutaway side view of the female connector housing shown in FIG. 1.
Figure 3:
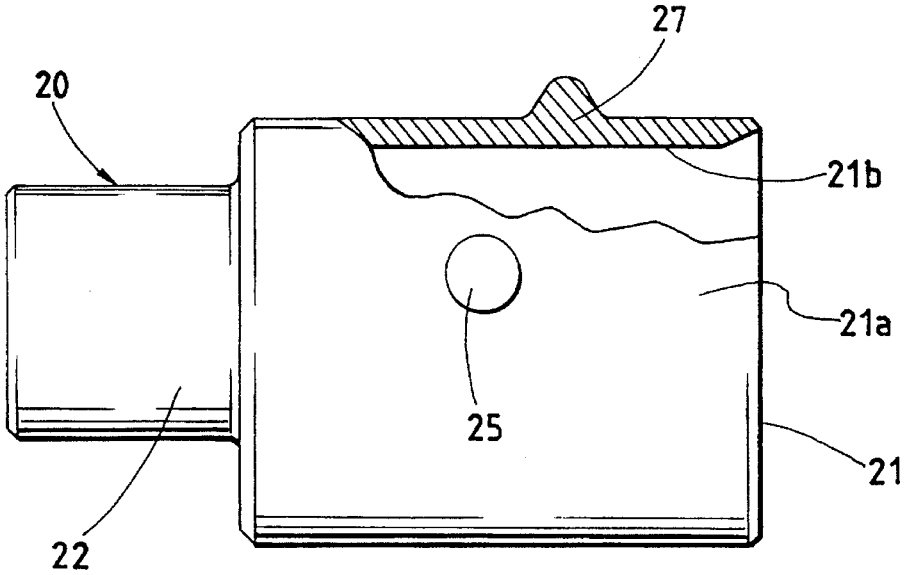
FIG. 3 is a partially cutaway side view of the male connector housing shown in FIG. 1.

FIG. 1 is an exploded perspective view of male and female connector housings 10 and 20, and FIGS. 2 and 3 are partially cutaway side views of the female connector housing 10 and the male connector housing 20, respectively.

In the female connector housing 10, a male connector portion 16 having a substantially rectangular section shape, and a hood unit 17 are integrally molded by a synthetic resin. The male connector unit 16 is provided with a terminal accommodating chamber for holding a plurality of plural terminal pieces (not shown) while the terminal pieces are insulated from each other. The hood unit 17 overhangs the outer peripheral portion of the male connector unit 16 in a tube-like manner, so as to form an accommodating space for receiving a housing peripheral wall 21 of the counter male connector housing 20. An operating lever 30 is rotatably supported on supporting shafts 14 which respectively project from the both side faces of the hood unit 17. The terminal pieces (not shown) which are respectively fixed to ends of plural wires are passed through wire insertion holes 13 formed in the side of the rear end of the housing, and held in the accommodating chamber of the male connector unit 16.

A pair of cutaway grooves 12 which are elongated in the directions of mating and unmating the connector housings and oppose to each other are respectively formed on the both side walls of the hood unit 17, so that, when the female connector housing 10 is to be coupled with the male connector housing 20, a pair of engaging projections 25 which respectively protrude from the both side faces of the male connector housing 20 do not interfere with the side walls of the hood unit 17.

A flexible cantilever-like locking piece 15 is integrally molded to the upper wall of the hood unit 17. The locking piece is integrated to the hood unit at the base end having the opening edge portion of the hood unit 17, and elongates toward the rear end of the housing. In cooperation with a pushup portion 27 of the male connector housing 20 functioning as the urging means, which will be described later, the flexible locking piece 15 functioning as the engaging means constitutes the lever locking means which inhibits the operating lever 30 from being rotated.

As shown in FIG. 2, the flexible locking piece 15 comprises a flexible plate-like portion 15*a* which is inclined with respect to the connector mating and unmating direction so that the front end of the locking piece enters the inside of the female connector housing 10, and a lever engaging portion 15*b* which is formed in the front end of the plate-like portion. The flexible locking piece can easily be deformed in an elastic manner so as to be parallel to the connector mating and unmating direction.

Figure 4:
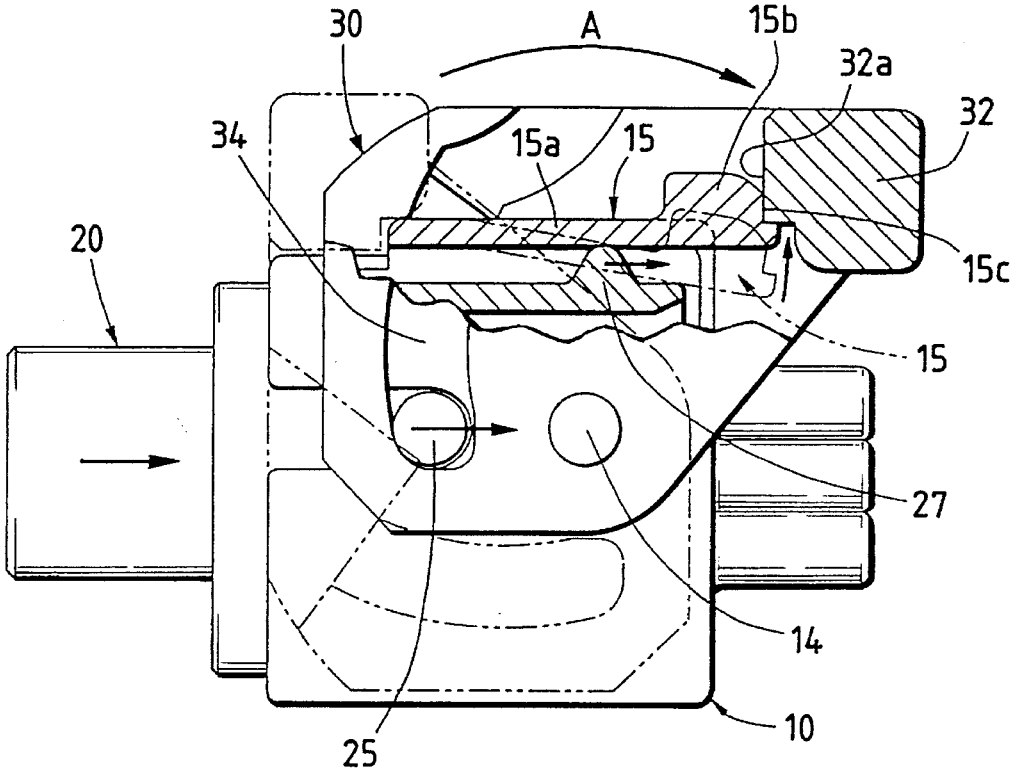
FIG. 4 is a partially cutaway side view showing a coupling state of the male and female connector housings shown in FIG. 1.

In the operating lever 30, a pair of side walls 31 parallel to each other, and an operating portion 32 connecting the side walls 31 with each other are integrally molded by a synthetic resin. Through holes 33 formed in the side walls 31 are fitted onto the supporting shafts 14 formed on the side faces of the female connector housing 10, whereby the operating lever 30 is rotatably supported. Cam grooves 34 which receive and guides the engaging projections 25 disposed on the both side faces of the male connector housing 20 are respectively formed in the side walls 31. Each of the cam grooves 34 is so configured that the innermost portion is closer to the respective supporting shaft 14 than the entrance of the groove. Furthermore, the operating portion 32 is provided with an engaging wall 32*a* which can engage with the lever engaging portion 15*b* of the flexible locking piece 15, as shown in FIG. 4.

The male connector housing 20 is provided with a terminal accommodating chamber (not shown) for holding a plurality of terminal pieces which are not shown, while the terminal pieces are insulated from each other. A wire passing portion 22 through which wires having terminal pieces fixed thereto pass is formed in the side of the rear end of the housing peripheral wall 21 which receives the male connector unit 16. The column-like engaging projections 25 which respectively engage with the cam grooves 34 of the operating lever 30 protrude from the both side faces of the housing peripheral wall 21. The pushup portion 27 projects from the upper face of the housing peripheral wall 21 in a vertical direction, and extends over the width direction of the housing. The pushup portion 27 functions as the urging means which presses the lower face of the flexible plate-like portion 15*a* to bend the portion 15*a* to the position where the lever engaging portion 15*b* engages with the operating lever 30.

Next, the operations of coupling and uncoupling the female and male connector housings 10 and 20 in the embodiment will be described with reference to FIGS. 4 and 5.

First, the male connector housing 20 and the female connector housing 10 are placed close to each other. While the operating portion 32 of the operating lever 30 is rotated toward the male connector housing 20 as indicated by two-dot chain lines in FIG. 4, the front end portion of the housing peripheral wall 21 of the male connector housing 20 is inserted between the male connector unit 16 and the hood unit 17 of the female connector housing 10. Then, the engaging projections 25 formed on the housing peripheral wall 21 of the male connector housing 20 are received by the entrances of the cam grooves 34 of the operating lever 30, respectively.

When, under this state, the operating portion 32 of the operating lever 30 is rotated in a clockwise direction (the direction of an arrow A), the projections 25 are gradually pulled along the cam shape of the cam grooves 34 in the direction approaching toward the supporting shafts 14, so that the male connector housing 20 is pressed against the female connector housing 10 and both the members are firmly coupled with each other.

During this process, the pushup portion 27 formed on the male connector housing 20 makes slidable contact with the lower face of the flexible locking piece 15 as it is moved toward the front end of the locking piece while upwardly urging the locking piece. Therefore, the flexible locking piece 15 which has been located at the position indicated by the two-dot chain lines in FIG. 4 is pushed up by the pushup portion 27 to be bent so as to be elongated in a direction substantially parallel to the direction of mating and unmating of the connector housings, with the result that the lever engaging portion 15*b* engages with the operating portion 32 of the operating lever 30. Namely, an engaging wall 15*c* of the lever engaging portion 15*b*, and the engaging wall 32*a* of the operating portion 32 engage with each other while opposing to each other and making close contact with each other.

Figure 5:
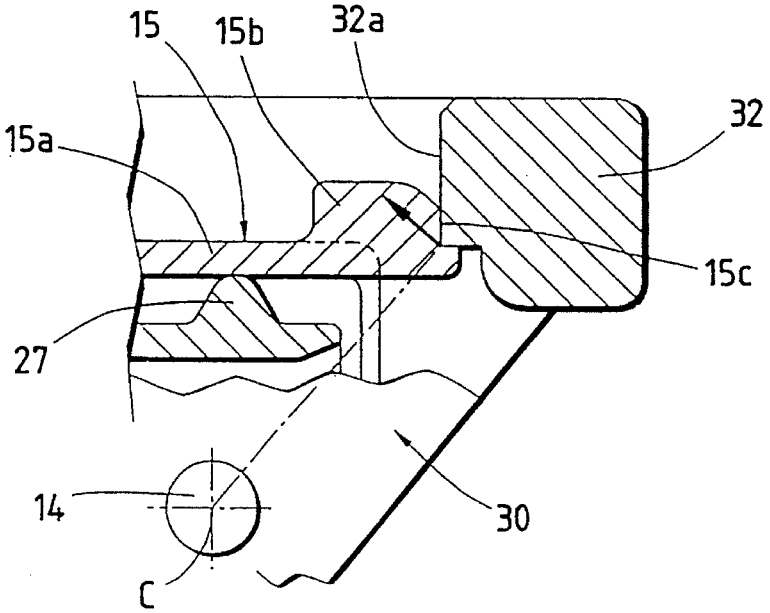
FIG. 5 is a partial enlarged view illustrating a coupling state of an operating lever and a flexible locking piece shown in FIG. 4.

Even when, as shown in FIG. 5, the engaging wall 32*a* is displaced in the direction of the arrow with setting the center C of the supporting shafts 14 as the rotation center, therefore, the displacement force balances with the force of the flexible locking piece 15 against the compression in the directions of mating and unmating the connector housings, so that the engagement of the engaging walls 32*a* and 15*c* cannot be canceled, resulting in that the operating lever 30 is inhibited from being rotated in the connector unmating direction. When the female and male connector housings 10 and 20 are coupled with each other, the operating lever 30 engages with the flexible locking piece 15 to be inhibited from being rotated in the direction along which the female and male connector housings 10 and 20 are separated from each other. Consequently, the occasion where the operating lever 30 is accidentally rotated and the fitting state of the female and male connector housings 10 and 20 is spontaneously canceled is prevented from occurring.

Figure 6:
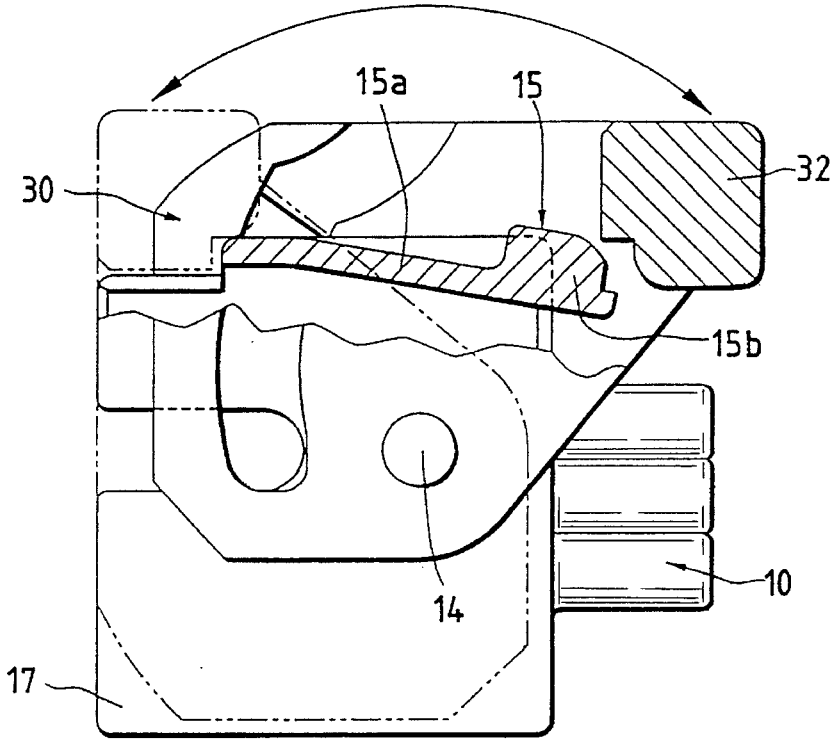
FIG. 6 is a partially cutaway side view showing the relative relationship between the operating lever and the flexible locking piece under the state where the female connector housing stands alone.

In contrast, when the female connector housing 10 stands alone, as shown in FIG. 6, the operating portion 32 of the operating lever 30 never makes contact with the flexible locking piece 15 because the flexible locking piece 15 is configured so that the lever engaging portion 15*b* elongates while inclining with respect to the connector mating and unmating directions, so as to enter the inside of the female connector housing 10 as described above. Accordingly, the flexible locking piece 15 does not inhibit the operating lever 30 from being rotated.

In other words, when the female connector housing 10 stands alone, the operating lever 30 does not engage with the flexible locking piece 15 and the rotation of the lever is not blocked. When the male connector housing 10 is to be coupled with the male connector housing 20, therefore, it is not required to conduct a useless work of disengaging the operating lever 30 from the flexible locking piece 15 to cancel the lock-up state. Consequently, the work of coupling the female and male connector housings 10 and 20 can be conducted satisfactorily.

Figure 7:
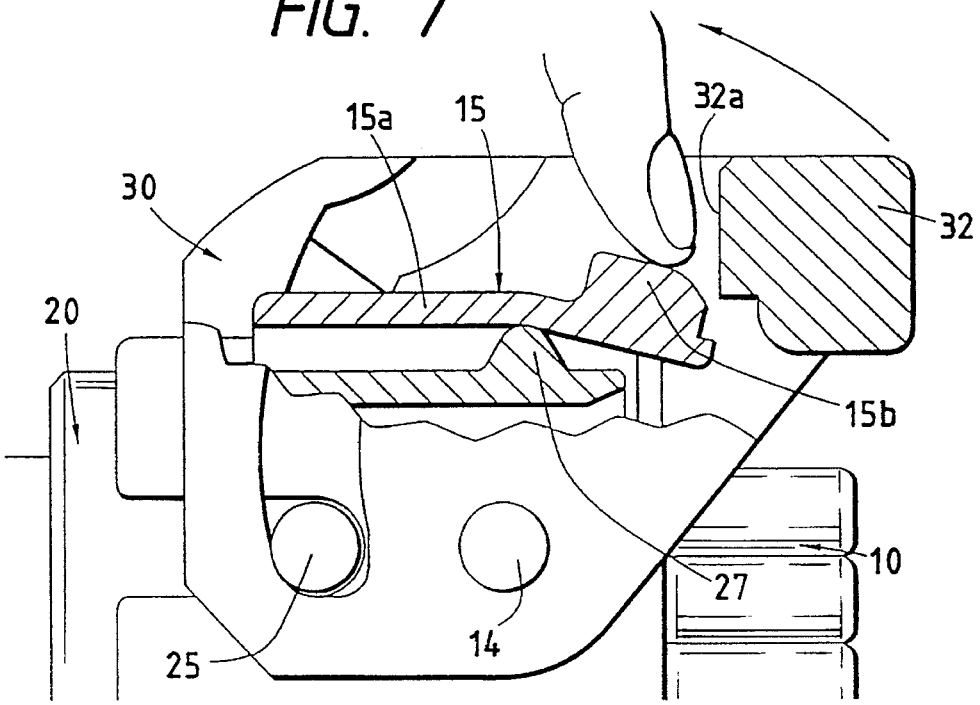
FIG. 7 is a partially cutaway side view illustrating a method of canceling the coupling state of the male and female connector housings shown in FIG. 4, FIGS. 8(*a*) and 8(*b*) are side views illustrating a conventional connector coupling mechanism used in male and female connector housings.
Figure 8A:
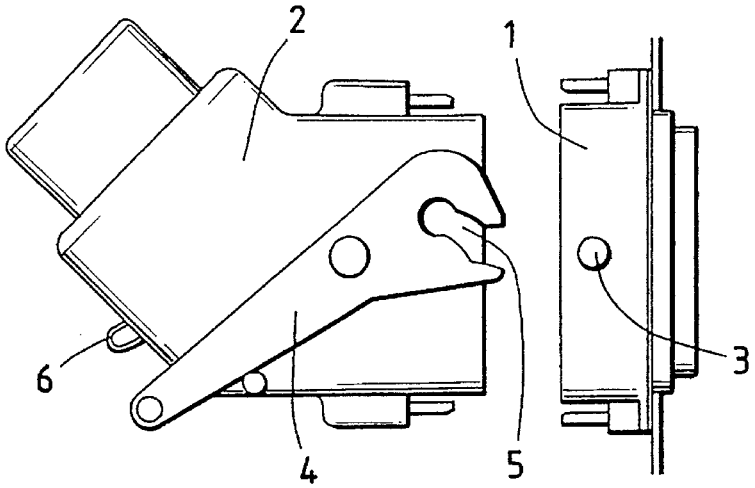
FIG. 8(a) PRIOR ART
Figure 8B:
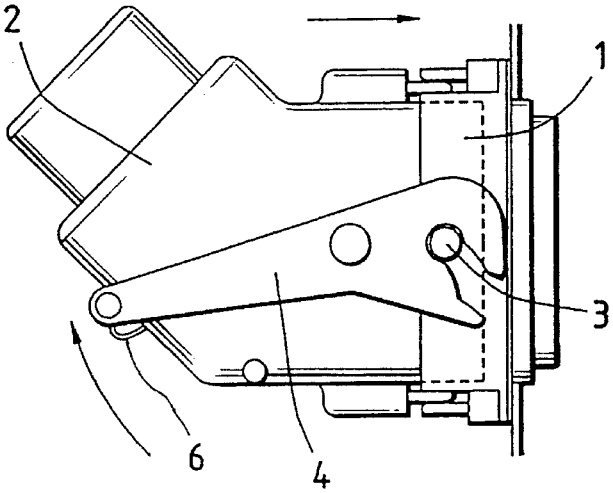
FIG. 8(b) PRIOR ART
Figure 9:
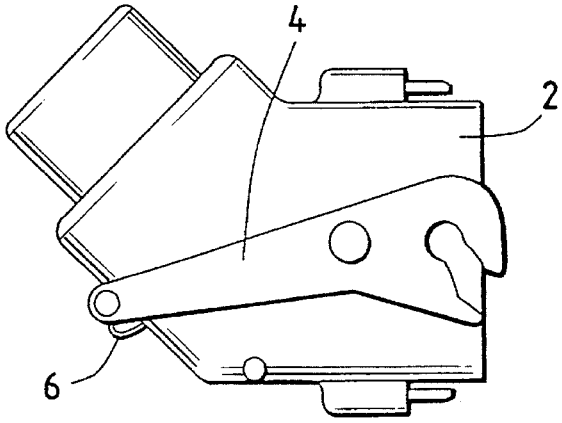
FIG. 9 PRIOR ART
FIG. 9 is a side view illustrating a lock-up state in the male connector housing comprising the conventional connector coupling mechanism shown in FIG. 8.

When the coupling state of the female and male connector housings 10 and 20 is to be canceled, the lever engaging portion 15*b* of the flexible locking piece 15 is pushed down by a finger as shown in FIG. 7, whereby the engagement of the lever engaging portion 15*b* and the engaging wall 32*a* is canceled so as to set the operating lever 30 to be rotatable. When the operating lever 30 is then rotated in a counterclockwise direction (the direction of an arrow B) in FIG. 7, the male connector housing 20 is disengaged from the female connector housing 10.

In this embodiment, the engaging means which, when the connectors are uncoupled from each other, is located at a position where the means does not engage with the operating lever 30, is constituted by the flexible locking piece 15, and the urging means for, when the connectors are coupled with each other, urging the flexible locking piece 15 to the position where the locking piece engages with the operating lever 30, is constituted by the pushup portion 27. It is needless to say that the lever locking means in the invention is not restricted to such a configuration and may be configured in various manners.

It is a matter of course that the connector housing coupling mechanism of the invention is not restricted to the embodiment described above, and may be applied to various kinds of female and male connector housings and include modifications in which the constituting members are suitably changed.

According to the connector housing coupling mechanism of the invention, when the female and male connector housings are separated from each other, the engaging means of the lever locking means for engaging with the operating lever to inhibit the operating lever from being rotated is located at a position where the engaging means does not engage with the operating lever. Consequently, the operating lever does not inhibit the operating lever from being rotated.

In other words, under the state where one of the connector housings which is provided with the operating lever stands alone, the operating lever is never engaged with the lever locking means. In the operation of coupling the female and male connector housings with each other, therefore, it is not required to conduct a useless work of disengaging the operating lever from the lever locking means.

In contrast, when the female and male connector housings are to be coupled with each other, the engaging means is urged by the urging means to the position where the engaging means engages with the operating lever, to engage with the operating lever. Therefore, the operating lever is inhibited from being rotated in the direction along which the female and male connector housings are separated from each other, so that the coupling state of the female and male connector housings is not accidentally canceled.

Consequently, the invention can provide a connector housing coupling mechanism of the operating lever type in which, under the state where female and male connector housings are not coupled with each other, an operating lever disposed on one of the connector housings is not inhibited by lever locking means from being rotated, so that an excellent workability is attained in the coupling operation.

What is claimed is:

1. A connector housing coupling mechanism, comprising:

a female connector housing;

a male connector housing;

an engaging projection which is formed on a first side face of one of said male and female connector housings;

an operating lever which is rotatably supported on a side face of the other one of said male and female connector housings, said operating lever comprising a cam groove which receives and guides said engaging projection depending on a rotation position of said operating lever, an innermost portion of said cam groove being closer to a rotation center of said operating lever than an entrance of said cam groove, said male and female connector housings being coupled with and uncoupled from each other by rotating said operating lever; and lever locking means for inhibiting said operating lever from being rotated, said lever locking means comprising: engaging means disposed on said other one of said male and female connection housings which, when said male and female connector housing are uncoupled from each other, is located at a position where said engaging means does not engage with said operating lever; and urging means disposed on said one of said male and female connector housing for, when said male and female connector housings are coupled with each other, urging said engaging means to a position where said engaging means engages with said operating lever, said operating lever being prevented by said engaging means from being rotated only when said male and female connector housings are coupled with each other.

2. A connector housing coupling mechanism according to claim 1, wherein said engaging means is constituted of a flexible locking piece which is formed on an upper face of said one of said male and female connector housings, said flexible locking piece elongating in a connector insertion direction, and said urging means comprises pushup means formed on an upper face of said other one of said male and female connector housings, said upper face of said other one of said male and female connector housings opposing said flexible locking piece, and when said male and female connector housings are coupled with each other, said pushup means pushes up said flexible locking piece to bend said flexible locking piece to a position where said flexible locking piece engages said operating lever.

* * * * *